US006006964A

United States Patent [19]

White

[11] Patent Number: 6,006,964

[45] Date of Patent: Dec. 28, 1999

[54] GARMENT HANGER

[76] Inventor: Michael J. White, 301 E. Wall St., Grapevine, Tex. 76051

[21] Appl. No.: 08/970,852

[22] Filed: Nov. 14, 1997

[51] Int. Cl.[6] ..... A47G 25/74

[52] U.S. Cl. ..... 223/85; 223/DIG. 1

[58] Field of Search ..... 223/85, DIG. 1, 223/DIG. 4, 92, 84, DIG. 2

[56] References Cited

U.S. PATENT DOCUMENTS

| | | | |
|---|---|---|---|
| 1,315,823 | 9/1919 | Dugan | 223/DIG. 1 |
| 3,370,715 | 2/1968 | Kolozsvari | 223/DIG. 1 |
| 3,993,205 | 11/1976 | Pilchard | 223/DIG. 1 |
| 5,038,979 | 8/1991 | Traylor | 223/88 |
| 5,328,065 | 7/1994 | Kolton et al. | 223/85 |
| 5,433,355 | 7/1995 | Watkins | 223/1 |
| 5,501,378 | 3/1996 | Kolton et al. | 223/87 |
| 5,620,118 | 4/1997 | Kolton et al. | 223/85 |

FOREIGN PATENT DOCUMENTS

| | | | |
|---|---|---|---|
| 1272990 | 8/1990 | Canada | 223/85 |
| 2332731 | 7/1977 | France | 223/92 |
| 1876678 | 5/1963 | Germany | 223/88 |

OTHER PUBLICATIONS

Modern Store Fixtures MFG. Co., catalog 91, selected pages.

*Primary Examiner*—Bibhu Mohanty
*Attorney, Agent, or Firm*—Guy V. Manning

[57] ABSTRACT

A garment hanger comprises a smooth rod shaped into a substantially horizontal arm coupled to a central, vertical hook. The horizontal arm is substantially the length necessary to span the garment being displayed. Coupled to one end of the arm is a shoulder portion looping back to near the middle of the arm, where the hook extends vertically upward and rearward from the shoulder and arm. The hook is angled such that it settles slightly to one side when loaded and hanging, encouraging garments to overlap when disposed along a hanger bar, but leaving a substantial portion of each garment exposed to frontal view.

17 Claims, 2 Drawing Sheets

GARMENT HANGER

BACKGROUND OF THE INVENTION

1. Field of the Invention

This invention relates to improvements to devices adapted to hang garments for display and storage, and specifically to devices and systems for hanging neckties so that they may be viewed efficiently by shoppers.

2. Description of Related Art

Numerous garments comprise relatively flat, often multilayered objects of significant length compared to their width, such as neckties, trousers and scarves. Stores selling such garments devise clever means to display together large selections of such garments while using as little floor space as possible. A tension arises, however, between department store frugality with floor space and manufacturers' demands that customers be able to view their garments efficiently.

For example, men's neckties usually are folded in half or fourths and hung from large arrays of pegs, one tie in front of the other, where only the first tie is visible frontally. A shopper wishing to view the other ties must push aside those in front, and removing any but the front tie can be cumbersome. This has led most tie manufacturers to require stores to display a sizeable portion of their inventory lying flat on tables or in display cases, maximizing the required floor space. A need exists for a system of displaying neckties which satisfies the manufacturers' concerns for visibility while reducing floor space requirements.

To demonstrate to shoppers how they may look together, retailers often slip ties under the collars of shirts and drape the ties downwardly similar to the way they would appear when worn. To keep the ties in place, the shirts usually are laid horizontally, occupying precious floor space. When shoppers handle such displays, however, they disturb the juxtaposition and leave the display in disarray anyway. To keep the ties in place, some stores pin them to the shirts. Movement of the display risks harm to both the tie and the shirt, however, and substitution of different ties becomes cumbersome. A need exists for convenient means to secure a tie to a shirt collar which is easily removable.

SUMMARY OF THE INVENTION

Accordingly, it is an object of this invention to provide a hanger for garments which efficiently displays frontally a large portion of the garment when several are hung together.

It is another object of this invention to provide a garment hanger system which maximizes the number of garments displayed per unit of floor space while maintaining efficient frontal visibility.

It is another object of this invention to provide a garment hanger which is inexpensive to manufacture.

It is yet another object of this invention to provide a hanger which efficiently may be used to display a necktie in place beneath a shirt collar.

The foregoing and other objects of this invention are achieved by providing a garment hanger comprising a smooth rod bent into a substantially horizontal arm coupled to a central, vertical hook. The horizontal arm is substantially the length necessary to span the garment being displayed. Coupled to one end of the arm is a shoulder portion looping back to near the middle of the arm, where the hook extends vertically upward and rearward away from the shoulder and arm. The hook is angled such that the hanger settles slightly to one side when loaded and hanging, encouraging garments to overlap along a hanger bar, but leaving a substantial portion of each garment exposed to frontal view.

BRIEF DESCRIPTION OF THE DRAWINGS

The novel features believed characteristic of the present invention are set forth in the appended claims. The invention itself, however, as well as a preferred mode of use and further objects and advantages thereof, will be understood best by reference to the following detailed description of an illustrative embodiment when read in conjunction with the accompanying drawings, wherein:

DETAILED DESCRIPTION OF A PREFERRED EMBODIMENT

Figure 1:
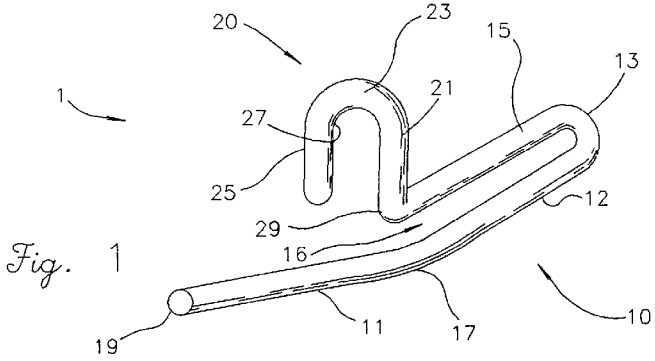
FIG. 1 depicts in perspective the garment hanger of the instant invention.
Figure 2:
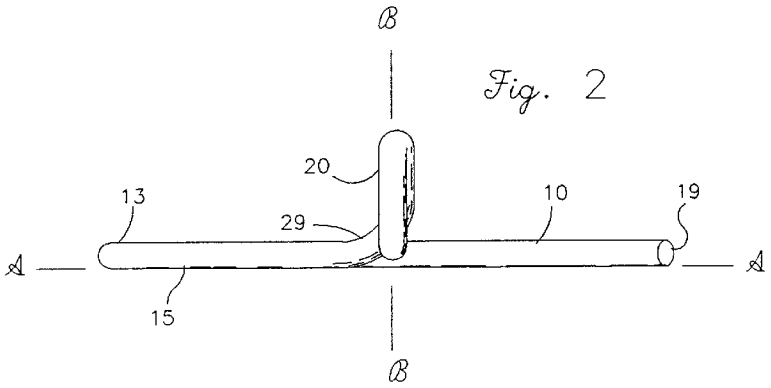
FIGS. 2, 3 and 4, respectively show a rear elevational, top and left side elevational views of the hanger of FIG. 1.
Figure 3:
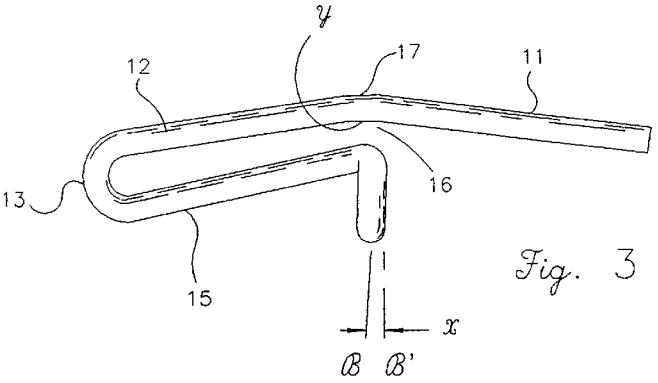
Figure 4:
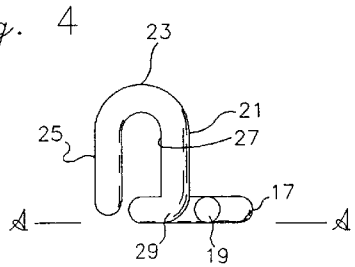

With reference now to the figures, and in particular to FIGS. 1, 2, 3 and 4, garment hanger 1 comprises arm 10 coupled to hook 20 through elbow 13 and shoulder 15. Arm 10 includes distal forearm 11 and proximate upper arm 12 separated by bend 17. Included angle "Y" (FIG. 3) of bend 17 is further discussed below. Shoulder 15 substantially parallels upper arm 12 from elbow 13 to near bend 17, where it couples to hook 20 at nape 29. As depicted in FIGS. 2 and 4, arm 10, elbow 13 and shoulder 15 may occupy a common plane A.

Figure 5:
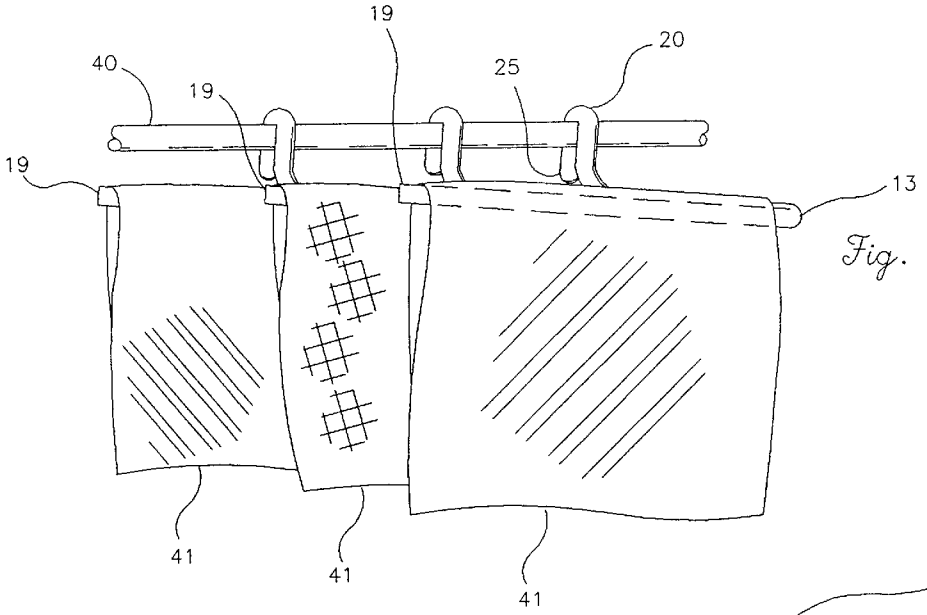
FIG. 5 shows several garment hangers loaded and suspended from a hanger bar.

Hook 20 extends upward and away from nape 29 in a second plane B substantially normal to plane A (see FIG. 2). Hook 20 comprises neck 21 proximate nape 29 and coupled to distal nose 25 through head 23. As seen in FIG. 5, nose 25, head 23 and neck 21 define eye 27 adapted to receive hanger bar 40 which supports multiple garments 41. A third plane B' bifurcates included angle Y of bend 17 (FIG. 3). Plane B lies at a small angle "X" relative to plane B'. Because of angle X, hanger 1 settles slightly askew to hanger bar 40 when loaded, pushing elbow 13 and tip 19 to opposite sides of bar 40. This facilitates and encourages overlap of garments 41. For neckties and most small, flat garments, angle X preferably lies between one and three degrees. One having ordinary skill in the art will recognize that angle X may vary substantially, depending upon the type of garment displayed, and that all angles between zero and ninety degrees are considered within the spirit and scope of this invention.

Eye 27 may vary in width and height, depending upon the size of bar 40. If nose 23 is too long, it hangs up on bar 40 during removal. If it is too short, hanger 1 easily may fall off bar 40. Nose 23 preferably extends approximately three-eighths (⅜") below the top of bar 40, when a load pivots hanger 1 on bar 40 (plane A tilted). Nose 23 thus remains short enough that hanger 1 easily may be removed and replaced on bar 40, yet long enough that it won't fall off hanger bar 40 easily. For a quarter (¼") inch bar, eye 27 preferably is approximately one-half (½") inch wide, and nose 25 preferably extends approximately five-eighths (⅝") inch below head 23 to within approximately one-tenth (1/10") inch of plane A. One having ordinary skill in the art will recognize that these dimensions are approximate and will vary with varying sizes of bar 40.

With only slight handling, any unbalanced load on hanger 1, such as a necktie or a pair of trousers, could tend to slide off arm 10 unless affixed in place. Bend 17 in arm 10 and gap 16, between bend 17 and nape 29, both address this problem. Bend 17 causes the edges of garment 41 to be pulled rearward toward nose 25, increasing friction between arm 10 and garment 41. Gap 16 is selected to bring nape 29 into close enough proximity to slightly clamp garment 41 against the inside of bend 17, holding garment 41 in place. For neckties, gap 16 preferably is approximately one-tenth (1/10") inch. Flexibility of elbow 13 and the roundness and smoothness of arm 10 and shoulder 15 prevent chaffing of garment 41 at gap 16. The resulting clamping effect also prevents hanger 1 from falling off and becoming lost when garment 41 is handled without gripping hanger 1.

Figure 6:
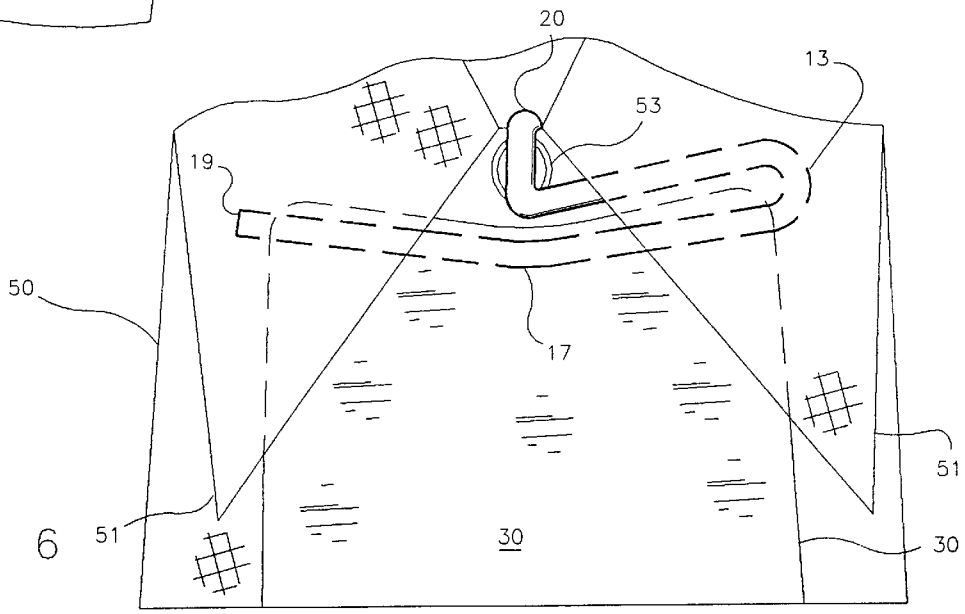
FIG. 6 shows a necktie attached to a shirt collar using the hanger.

FIG. 6 demonstrates use of hanger 1 to secure a necktie 30 to collar 52 of shirt 50. Hook 20 loops over button 53 while elbow 13 and tip 19 pull the edges of necktie 30 under collar tips 51, creating a smooth, even display. Absent bend Y, elbow 13 and tip 19 would lie closer to collar tips 51, causing the thickness of tie 30 to prevent collar tips 51 from lying flat. With necktie 30 secured to collar 53 by hanger 1, shirt 50 may be placed at any angle without fear of necktie 30 falling out of place. Thus, shirt 50 may be placed upright, leaning against a back support, and occupying considerably less floor space than necessary if it must be laid flat.

Hanger 1 may be fabricated from an array of smooth, flexible materials such as coated wire, tubing or plastics. Preferably, hanger 1 is composed of light weight hydrocarbon solids such as acrylic, polyethylene, polystyrene or polypropylene and fabricated by extrusion, stamping or other convenient process. Most preferably, hanger 1 is made by injection molding from a polypropylene homopolymer resin, ideal for aesthetics, structural integrity, flexibility and cost considerations. A suitable polypropylene homopolymer is available from Amoco Chemical Company of Chicago, Ill., under the product designation "Amoco Polypropylene Homopolymer Injection Molding Resin Grade 4018".

Hanger bar 40 may be made from a variety of materials, such as steel, acrylic, wood or the like, requiring different diameters to minimize sagging, with corresponding variations in the size of eye 27. For tie displays, hanger bar 40 preferably comprises solid, coated brass or steel rods one quarter (¼") inch to three-sixteenth (3/16") inch in diameter. Such size minimizes the visual impact of bar 40 while retaining sufficient strength where supported at eighteen (18") inch to twenty-four (24") inch intervals. For this size hanger bar 40, eye 27 would be one-half (½") inch, and further dimensioned as discussed above.

While the instant invention has been particularly shown and described with reference to a preferred embodiment, it will be understood by those skilled in the art that various changes in form and detail may be made therein without departing from the spirit and scope of the invention. For example, FIG. 5 demonstrates left- and right-handedness of hanger 1. Garments 41 are shown overlapped such that tip 19 extends toward the shopper and forward of bar 40, while elbow 13 extends rearward of bar 40 away from the shopper. This offset prevents shoulder 15 from chaffing garment 41 on adjacent hanger 1. It is achieved by shifting hook 20 in plane B clockwise relative to plane B' by angle X, as seen in FIG. 3. The direction of angle X thus depends upon which direction the merchant prefers that garments 41 be angled. Merchants are known to believe that shoppers prefer to "read" the display from left to right. This demands that tips 19 be seen on the left edge of garment 41, as shown in FIG. 5. The opposite hand hanger (not shown) could be used to display a right-to-left progression, with a corresponding redirection of angle X.

I claim:

1. A garment hanger comprising an arm comprising forearm and upper arm segments;

a shoulder substantially the length of the upper arm segment and coupled thereto at an elbow; and a hook coupled to the shoulder opposite the arm at a nape, whereby the arm and shoulder occupy a first plane, and the hook occupies a second plane disposed substantially between the arm segments and substantially normal to the first plane.

2. The garment hanger according to claim 1 wherein the shoulder is disposed substantially parallel to the upper arm segment.

3. The garment hanger according to claim 1 and further comprising affixing means for affixing the garment to the hanger.

4. The garment hanger according to claim 3 wherein the affixing means comprises juxtaposition of the nape and the arm to define a gap adapted to receive and frictionally to secure the garment to the hanger.

5. The garment hanger according to claim 3 wherein the affixing means comprises a central bend in the arm.

6. The garment hanger according to claim 3 wherein the affixing means comprises a central bend in the arm; and a gap formed by the juxtaposition of the nape near the bend in the arm.

7. A garment hanger comprising an elongated arm having proximate and distal arm segments extending from an elbow;

a shoulder substantially the length of the proximate arm segment and disposed substantially parallel thereto and coupled thereto by the elbow;

a hook coupled to the shoulder opposite the elbow by a nape, the hook being disposed in a plane oriented substantially perpendicular to the arm; and affixing means for affixing the garment to the hanger.

8. The garment hanger according to claim 7 wherein the affixing means comprises juxtaposition of the nape and the arm to define a gap adapted to receive and frictionally to secure the garment to the hanger.

9. The garment hanger according to claim 7 wherein the affixing means comprises a central bend in the arm between the proximate and distal arm segments.

10. The garment hanger according to claim 7 wherein the affixing means comprises a central bend in the arm; and a gap formed by the juxtaposition of the nape near the bend in the arm.

11. The garment hanger according to claim 7 wherein the arm further comprises a central bend.

12. A garment hanger comprising an elongated arm having a proximate arm segment coupled to an elbow and a distal arm segment coupled to the proximate arm segment by an obtuse angle;

a shoulder disposed substantially parallel to the proximate arm segment and coupled to the elbow;

a hook coupled to the shoulder opposite the elbow by a nape; and a gap formed by juxtaposition of the nape near the angle in the arm, whereby a thickness of the garment is compressed between the nape and the angle.

13. A system for frontally displaying multiple garments comprising a horizontally supported hanger bar;

a plurality of garment hangers disposed along the hanger bar and suspended therefrom, each garment hanger further comprising an elongated arm having two arm segments separated by an obtuse angle;

a shoulder coupled to the arm at an elbow and terminating proximate the angle; and a hook coupled to the shoulder opposite the arm at a nape and removably receiving the hanger bar within an eye formed by the hook, whereby a garments draped over the arms of adjacent hangers are suspended in overlapping juxtaposition.

14. The garment hanger system according to claim 13 wherein the nape is disposed near a bend in the arm, the separation between the nape and the arm defining a gap adapted to receive and to compress the garment and thereby frictionally to secure the garment to the hanger.

15. An improved method of displaying a necktie with a shirt having a collar with a button and collar tips, the necktie having opposing wide and narrow ends, the method comprising the steps of providing a necktie hanger, the hanger having a cylindrical arm having a central bend;

a cylindrical shoulder coupled to the arm at an elbow; and a hook coupled to the shoulder opposite the arm at a nape; then folding the necktie and draping its wide and narrow ends on opposite sides of the arm; then placing the hook over the shirt collar at its button;

positioning the arm beneath the collar tips; then positioning the shirt for viewing by shoppers.

16. The garment hanger according to claim 1 wherein the forearm and upper arm segments are separated by an obtuse central angle, whereby a garment disposed along the arm conforms to the angle.

17. The garment hanger according to claim 1 wherein the forearm and upper arm segments are of substantially equal length.

* * * * *